US008007164B2

(12) United States Patent
Miyano et al.

(10) Patent No.: US 8,007,164 B2
(45) Date of Patent: Aug. 30, 2011

(54) MIXING TIP

(75) Inventors: Tatsunosuke Miyano, Itabashi-ku (JP); Masayuki Takahashi, Itabashi-ku (JP); Kazuma Noguchi, Soka (JP)

(73) Assignee: GC Corporation, Tokyo (JP)

( * ) Notice: Subject to any disclaimer, the term of this patent is extended or adjusted under 35 U.S.C. 154(b) by 429 days.

(21) Appl. No.: 12/051,358

(22) Filed: Mar. 19, 2008

(65) Prior Publication Data

US 2008/0232187 A1 Sep. 25, 2008

(30) Foreign Application Priority Data

Mar. 22, 2007 (JP) ..... 2007-075235

(51) Int. Cl.
*B67D 5/56* (2006.01)

(52) U.S. Cl. ..... 366/173.1; 222/145.6

(58) Field of Classification Search ..... 366/171.1, 366/172.1–173.2, 176.1, 181.5; 222/145.5, 222/145.6

See application file for complete search history.

(56) References Cited

U.S. PATENT DOCUMENTS

| | | | | |
|---|---|---|---|---|
| 4,771,919 | A * | 9/1988 | Ernst | 222/134 |
| 6,394,314 | B1 | 5/2002 | Sawhney et al. | |
| 6,843,652 | B2 * | 1/2005 | Xie et al. | 433/90 |
| 7,316,330 | B2 * | 1/2008 | Muller et al. | 222/145.6 |
| 7,387,432 | B2 * | 6/2008 | Lu et al. | 366/339 |
| 7,556,618 | B2 * | 7/2009 | Sogaro | 604/191 |
| 7,568,486 | B2 * | 8/2009 | Vrus | 132/208 |
| 7,631,782 | B2 * | 12/2009 | Engelbrecht et al. | 222/145.6 |
| 2002/0198490 | A1 | 12/2002 | Wirt et al. | |
| 2005/0230422 | A1 * | 10/2005 | Muller et al. | 222/145.6 |
| 2007/0175921 | A1 * | 8/2007 | Keller | 222/137 |
| 2008/0083782 | A1 * | 4/2008 | Heusser et al. | 222/145.5 |
| 2008/0232187 | A1 * | 9/2008 | Miyano et al. | 366/130 |
| 2008/0314929 | A1 * | 12/2008 | Keller | 222/145.6 |
| 2009/0152300 | A1 * | 6/2009 | Hayman et al. | 222/145.6 |
| 2010/0012210 | A1 * | 1/2010 | Miyano et al. | |
| 2010/0102088 | A1 * | 4/2010 | Keller | |

FOREIGN PATENT DOCUMENTS

| | | |
|---|---|---|
| EP | 1 389 448 A1 | 2/2004 |
| JP | 4-239477 | 8/1992 |
| JP | 8-276125 | 10/1996 |

OTHER PUBLICATIONS

U.S. Appl. No. 12/494,924, filed Jun. 30, 2009, Miyano, et al.
Search Report issued Nov. 11, 2009, in European Patent Application No. 08005179.0.

* cited by examiner

*Primary Examiner* — Charles E Cooley
(74) *Attorney, Agent, or Firm* — Oblon, Spivak, McClelland, Maier & Neustadt, L.L.P.

(57) ABSTRACT

For easier and surer fixing to a syringe holder, a mixing tip fixed at two portions of a top end of a syringe holder (X) containing two parallel syringes (Y, Y) comprising: a housing (2) including a mixing element (1); a paste guiding member (3) including paste inlets (3*a*) attached to nozzles of two syringes (Y, Y), and flow paths (3*b*) to introduce pastes extruded from the syringes into the housing (2) through the paste inlets (3*a*); and two locking members fixed at or integrally formed with the paste guiding member (3) or the housing (2) to be locked to the syringe holder (X), wherein the two locking members are a pawl part (4) locked with a locking hole (Xa) formed at the syringe holder (X) and a projection part (5) inserted into a hole part (Xb) provided at the syringe holder (X), or two pawl parts (4, 4).

1 Claim, 5 Drawing Sheets

MIXING TIP

BACKGROUND OF THE INVENTION

1. Field of the Invention

The present invention relates to a mixing tip which can be easily and certainly locked and fixed at a syringe holder in which two syringes respectively containing pastes are fixed in parallel.

2. Description of the Conventional Art

When plural pastes are mixed and kneaded, a static mixing tip to mix and knead the pastes extruded from syringes respectively containing the paste is utilized. This mixing tip is locked and fixed at a top end of a syringe holder in which plural syringes are attached in parallel.

Such a mixing tip is required to be easily locked and fixed at a syringe holder. For example, Unexamined Japanese Patent Publication No. 8-276125 discloses such a mixing tip. This mixing tip (a mixer) is made to have an insertion projection at an outer face of a lower end, and a syringe holder (a cartridge) is made to have an insertion piece to receive the insertion projection of the mixing tip. Then, the mixing tip is contacted with the syringe holder so that the insertion projection intersects the insertion piece. Then, the insertion projection and the insertion piece are rotated by approximately 90° so as to lock and fix the mixing tip. However, the mixing tip is not certainly locked because of only being rotated and locked, and thus any prevention mechanism is necessary in order to avoid falling off of the mixing tip.

Further, in order to more certainly lock and fix a mixing tip, for example, Unexamined Japanese Patent Publication No. 4-239477 discloses a cartridge. According to this structure, plural syringes having top ends which form one male screw when those syringes are assembled, are used. A mixing tip is contacted with the top end portions of the syringes forming a male screw. Then, while keeping this contacting state, a coupling nut is screwed onto the male screw so as to cover them, and thereby the mixing tip and the syringes are connected. However, since the coupling nut must be screwed onto the male screw in the case of this cartridge, it takes time and work to attach the mixing tip. Further, a specific process to from a male screw in the state of the plural syringes being assembled is necessary.

SUMMARY OF THE INVENTION

In order to solve the above-described problems, an objective of the present invention is to provide a mixing tip capable of being easily and certainly locked and fixed on a syringe holder.

The present inventors carried out earnest works to solve the above-described problems and, as a result of this, they found out the followings to complete the present invention. A mixing tip locked and fixed at two portions of a top end of a syringe holder, in which two syringes are fixed in parallel, is structured to comprise a housing, a paste guiding member, and two locking members. The housing internally includes a mixing element. The paste guiding member includes paste inlets attached to nozzles of respective syringes and flow paths to introduce pastes extruded from the respective syringes into the housing through the paste inlets. The paste guiding member is fixed to an end part positioned at the opposite side to an outlet of the housing. The two locking members are fixed at or integrally formed with the paste guiding member so as to be locked and fixed to the syringe holder. By having this structure, a mixing tip is locked by two locking members only by inserting into a syringe holder.

Thus, the mixing tip can be very easily locked and fixed. Further, the two locking members are a pawl part to be locked with a locking hole formed at the syringe holder and a projection to be inserted into a hole part provided at the syringe holder, or two pawl parts to be locked with respective locking holes formed at the syringe holder. Then, the mixing tip can be certainly locked and fixed to the syringe holder by the pawl parts.

An aspect of the present invention is a mixing tip locked and fixed at two portions of a top end of a syringe holder in which two syringes are fixed in parallel, and this mixing tip comprising a housing, a paste guiding member, and two locking members. The housing internally includes a mixing element. The paste guiding member includes paste inlets attached to nozzles of respective syringes and flow paths to introduce pastes extruded from the respective syringes into the housing through the paste inlets. The paste guiding member is fixed to an end part positioned at the opposite side to an outlet of the housing. The two locking members are fixed at or integrally formed with the paste guiding member so as to be locked and fixed to the syringe holder. The two locking members are a pawl part locked with a locking hole formed at the syringe holder and a projection inserted into a hole part provided at the syringe holder, or two pawl parts locked with respective locking holes formed at the syringe holder.

Further, it has been also found out that, when the pawl part includes a releasing mechanism to release the locking state of the pawl part with the syringe holder, the mixing tip can be changed easily, and thus it is preferable.

The mixing tip according to the present invention is locked and fixed at two portions of a top end of a syringe holder in which two syringes are fixed in parallel, and this mixing tip comprising a housing, a paste guiding member, and two locking members. The housing internally includes a mixing element. The paste guiding member includes paste inlets attached to nozzles of respective syringes and flow paths to introduce pastes extruded from respective syringes into the housing through the paste inlets. The paste guiding member is fixed to an end part positioned at the opposite side to an outlet of the housing. The two locking members are fixed at or integrally formed with the paste guiding member so as to be locked and fixed to the syringe holder. Owing to such the structure, the mixing tip is locked with two locking members only by inserting into a syringe holder. Thus, the mixing tip can be very easily locked and fixed. Further, the two locking members are a pawl part locked with a locking hole formed at the syringe holder and a projection inserted into a hole part provided at the syringe holder, or two pawl parts locked in locking holes formed at the syringe holder. Thus, a mixing tip is not jolted because it is fixed by two locking members. Further, a mixing tip can be installed certainly to a syringe holder because it is locked to a syringe by at least one pawl part.

Further, when pawl part includes a releasing mechanism to release the locking state of the pawl part with a syringe holder, a mixing tip can be easily removed or changed. Thus, the paste remaining in a syringe is not wasted by changing the mixing tip when a paste in a mixing tip is solidified.

DETAILED DESCRIPTION OF PREFERRED EMBODIMENT

A mixing tip according to the present invention will be described in detail with reference to the drawings.

Figure 1:
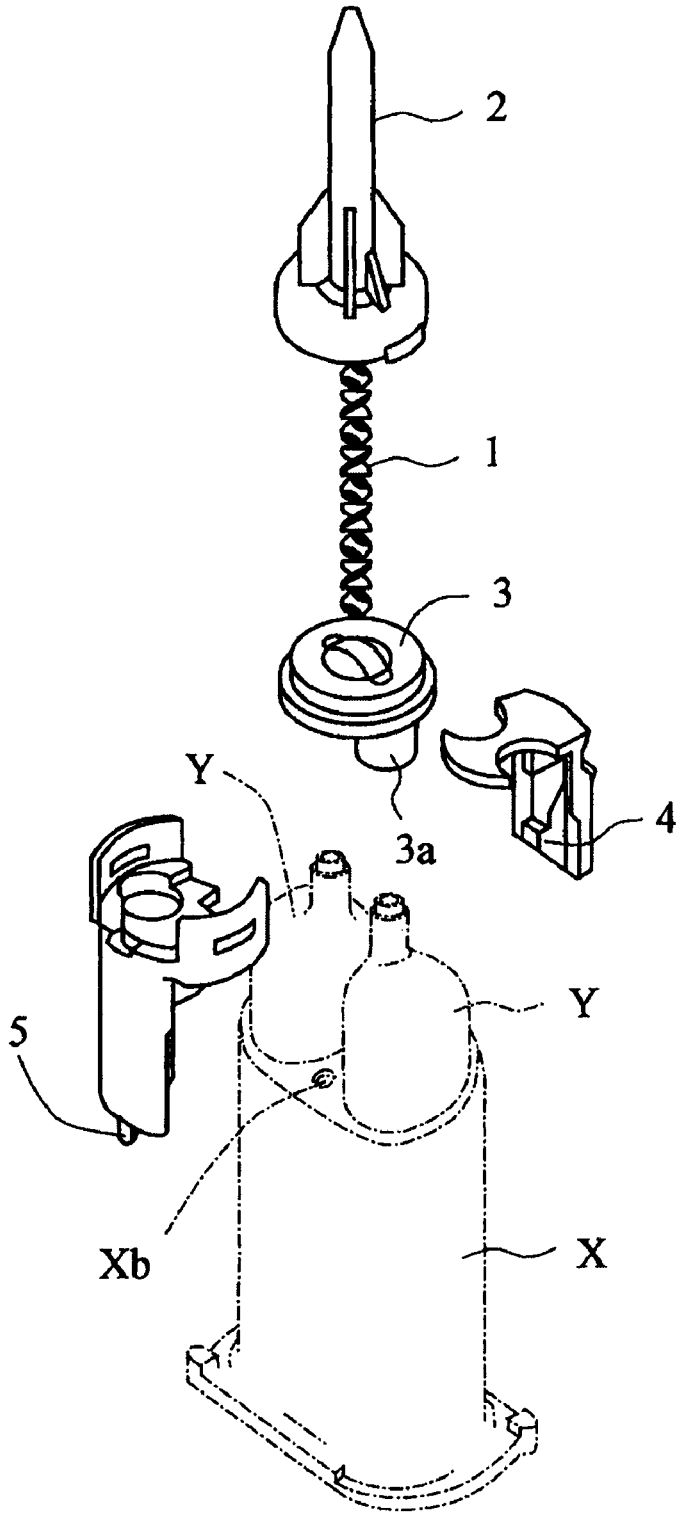
FIG. 1 is a perspective view to illustrate a state in which one example of a mixing tip according to the present invention is disassembled.
Figure 2:
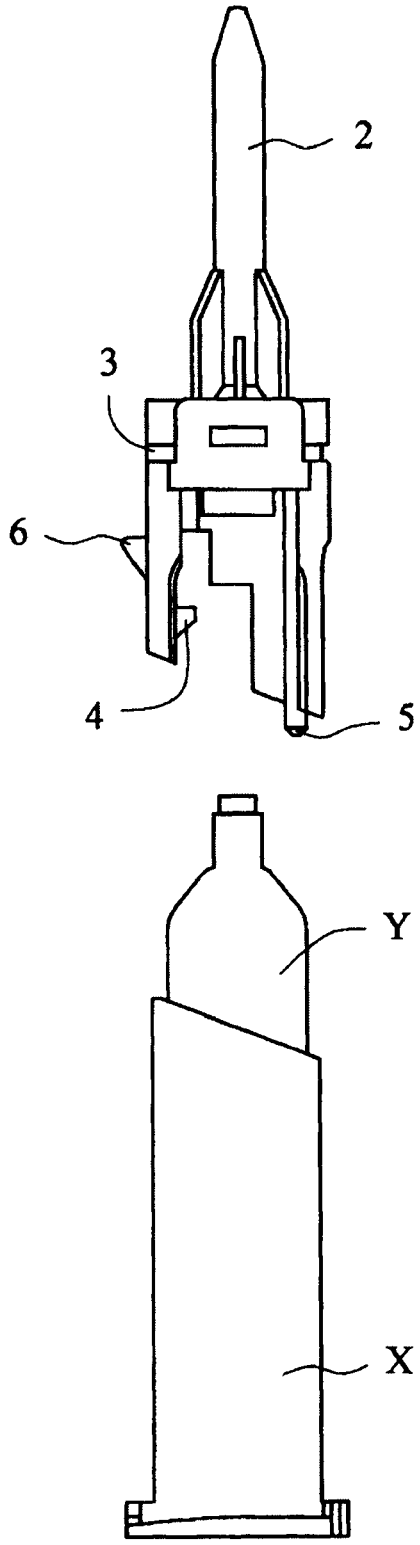
FIG. 2 is a side view to illustrate a state before locking and fixing of the mixing tip according to the present invention in FIG. 1 with a syringe holder.
Figure 3:
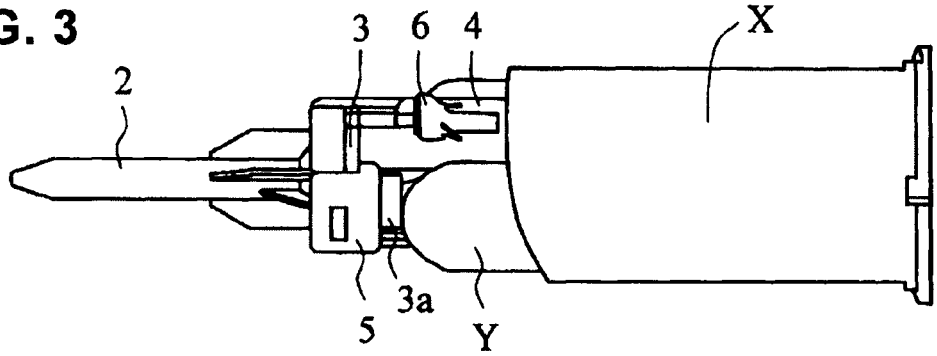
FIG. 3 is a side view to illustrate a state in which the mixing tip according to the present invention in FIG. 1 is locked and fixed with a syringe holder.
Figure 4:
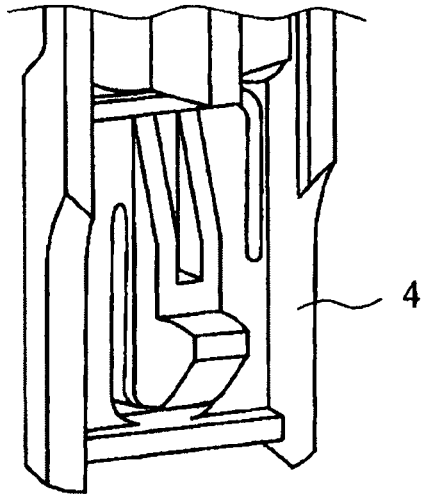
FIG. 4 is an enlarged perspective view to illustrate a pawl part of a mixing tip according to the present invention.
Figure 5:
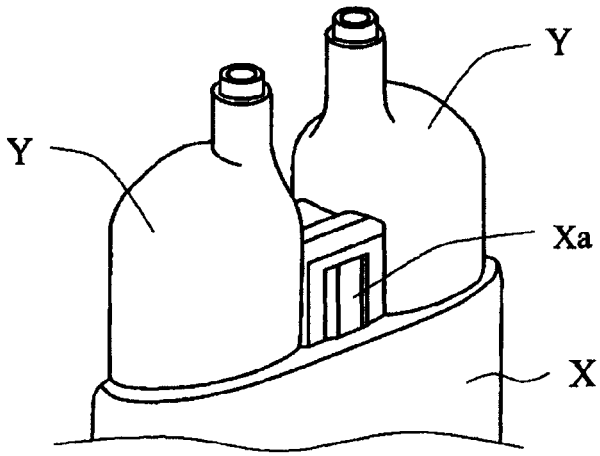
FIG. 5 is a perspective view to illustrate a locking hole of a syringe holder, in which a pawl part of a mixing tip according to the present invention is locked.
Figure 6:
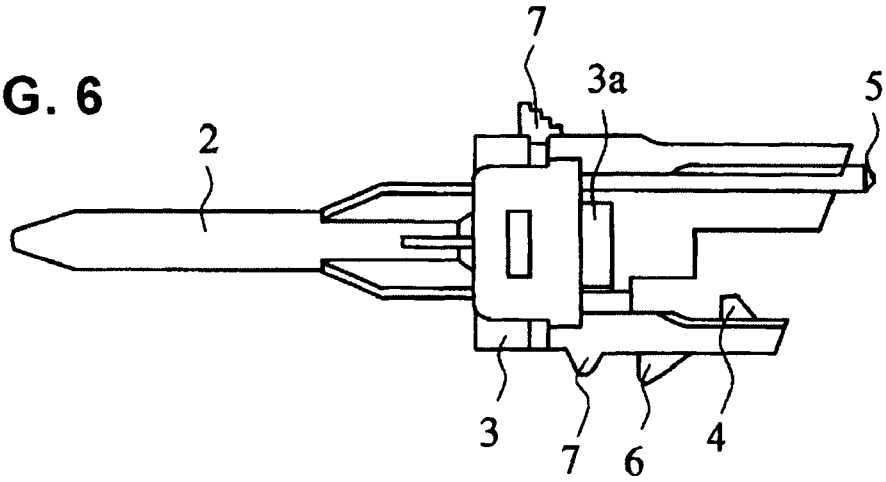
FIG. 6 is a side view to illustrate another example of a mixing tip according to the present invention.
Figure 7:
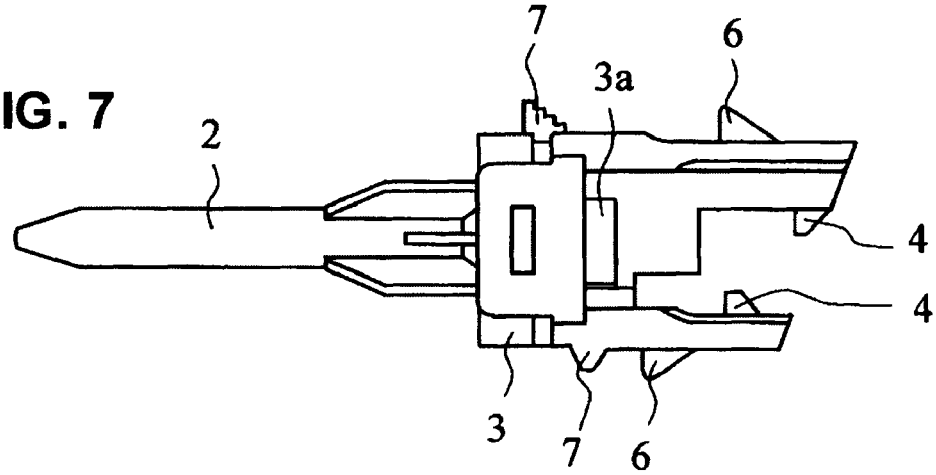
FIG. 7 is a side view to illustrate another example of a mixing tip according to the present invention.
Figure 8:
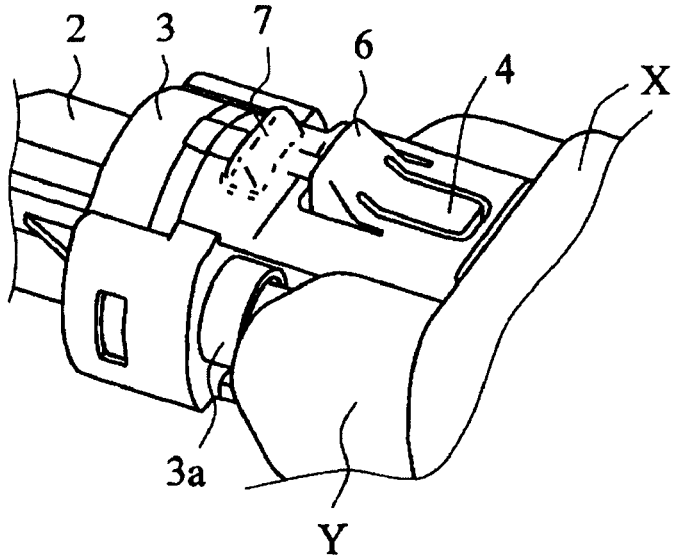
FIG. 8 is an enlarged perspective view to illustrate a releasing mechanism provided at a pawl part of a mixing tip according to the present invention.
Figure 9:
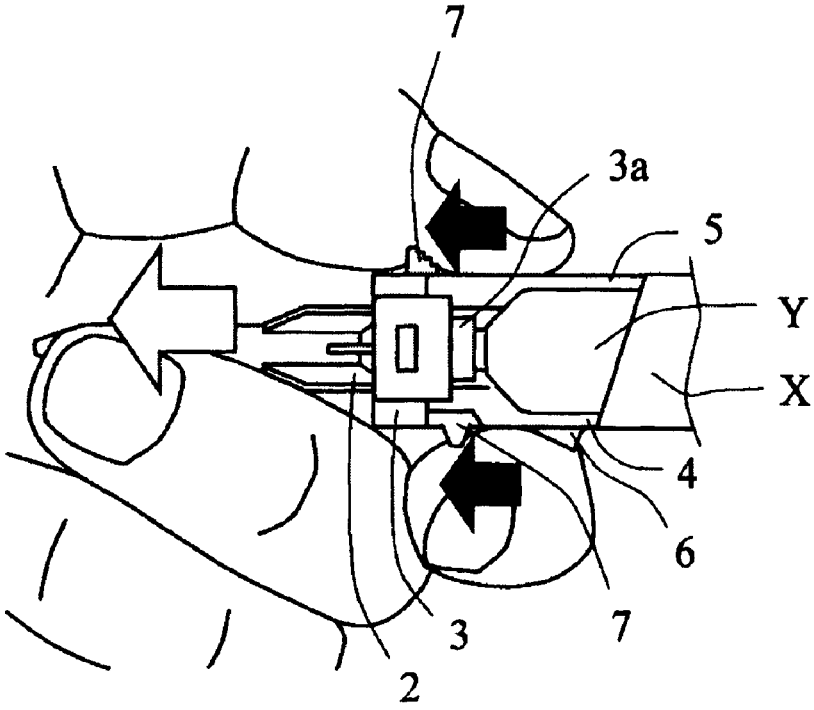
FIG. 9 is a view to illustrate a state when a mixing tip according to the present invention is removed.
Figure 10:
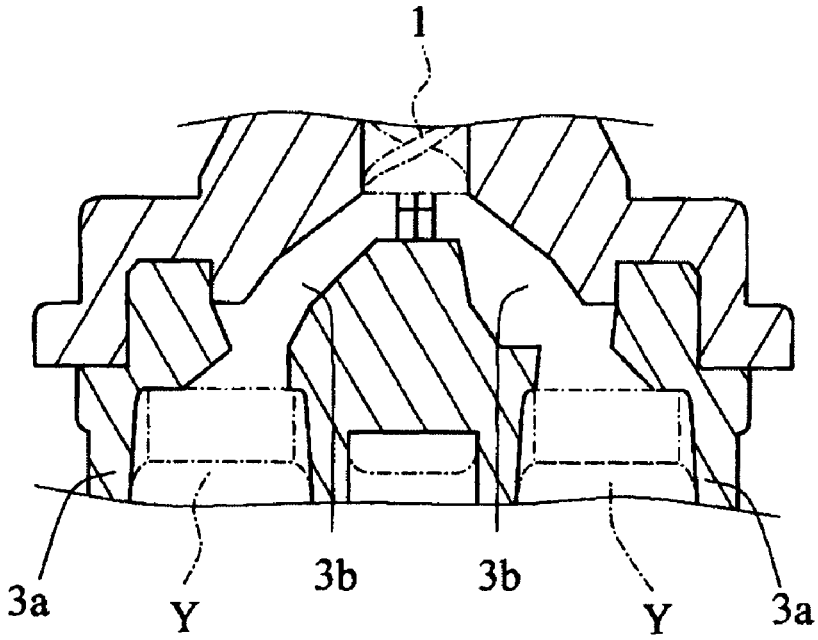
FIG. 10 is a sectional view to illustrate the internal structure of a paste guiding member.

FIG. 1 is a perspective view to illustrate a state in which one example of a mixing tip according to the present invention is disassembled. FIG. 2 is a side view to illustrate a state before locking and fixing of the mixing tip according to the present invention in FIG. 1 with a syringe holder. FIG. 3 is a side view to illustrate a state in which the mixing tip according to the present invention in FIG. 1 is locked and fixed with a syringe holder. FIG. 4 is an enlarged perspective view to illustrate a pawl part of a mixing tip according to the present invention. FIG. 5 is a perspective view to illustrate a locking hole of a syringe holder in which a pawl part of a mixing tip according to the present invention is locked. FIG. 6 is a side view to illustrate another example of a mixing tip according to the present invention. FIG. 7 is a side view to illustrate another example of a mixing tip according to the present invention. FIG. 8 is an enlarged perspective view to illustrate a releasing mechanism provided at a pawl part of a mixing tip according to the present invention. FIG. 9 is a view to illustrate the state when a mixing tip according to the present invention is removed. FIG. 10 is a sectional view to illustrate the internal structure of a paste guiding member.

In the drawings, a mixing element 1 is provided in a housing 2. The mixing element 1 is not especially limited if it can sufficiently mix and knead pastes to be used. The housing 2 is not especially limited, but a transparent or translucent housing is preferable so as to enable to see an internal paste.

A paste guiding member 3 includes paste inlets 3*a* attached to nozzles of two syringes Y and Y, and flow paths 3*b* to introduce pastes extruded from the respective syringes Y and Y into the housing 2 through the paste inlets 3*a*. The paste guiding member 3 is fixed to an end part positioned at the opposite side to an outlet of the housing 2. The flow paths 3*b* of the paste guiding member 3 connects the syringes Y and Y with the housing 2. A kneaded material having proper ratio can be obtained from the beginning of kneading process by adjusting the cross-sectional ratio or the volume ratio of the flow paths 3*b*.

Locking members 4 and 5 are fixed at or integrally formed with the paste guiding member 3 or the housing 2 so as to lock and fix the mixing tip to a syringe holder X. A pawl part 4 is locked with a locking hole Xa formed at the syringe holder X. A projection part 5 is inserted into a hole part Xb provided at the syringe holder X. The mixing tip according to the present invention has such the two locking members. The two locking members are the pawl part 4 locked with the locking hole Xa formed at the syringe holder X and the projection part 5 inserted into the hole part Xb provided at the syringe holder X, or the two pawl parts 4 and 4 locked with locking holes Xa and Xa formed at the syringe holder. At least one of the locking members is the pawl part 4. Thus, the mixing tip can be certainly locked and fixed to the syringe holder X.

In the embodiment of FIG. 2, locking members are the pawl part 4 and the projection part 5. The pawl part 4 is inwardly projected and locked with the locking hole Xa formed at the syringe holder X. On the other hand, the projection part 5 is only inserted into the hole part Xb provided at the syringe holder X, but the mixing tip is locked at two points. Thus, the mixing tip according to the present invention can be certainly locked and fixed without jolting. As illustrated in FIG. 7, when both of two locking members are the pawl parts 4, a mixing tip can be more certainly locked and fixed.

A releasing mechanism 6 is provided at the pawl part 4 so as to release the locking state of the pawl part 4 with the syringe holder X. Among the two locking members, only the pawl part 4 is locked so as not to be removed from the syringe holder X. Thus, when the releasing mechanism 6 releases the locking state of the pawl part 4, the mixing tip can be easily removed.

When the mixing tip according to the present invention is produced, since the mixing element 1 is provided in the housing 2, it is hard to integrally form the mixing element with the paste guiding member 3. Thus, these are produced and fixed separately.

On the other hand, the paste guiding member 3 and the two locking members can be integrally formed, at least two of them can be integrally formed, or these can be produced and fixed separately as illustrated in FIG. 1.

When the mixing tip according to the present invention is actually locked and fixed at the top end of the syringe holder X, the mixing tip according to the present invention can be easily locked and fixed by only pushing the mixing tip toward the top end of the syringe holder X in which two syringes Y and Y are fixed in parallel, as illustrated in FIG. 2.

In the embodiment of FIG. 2, the mixing tip according to the present invention has such a shape that the projection part 5 is more projected than the pawl part 4, and the syringe holder X has a shape of being obliquely cut at the top end side thereof corresponding to the shape of the mixing tip. Therefore, when a mixing tip is going to be locked and fixed in a wrong direction, an operator can recognize it early, and thus the mixing tip is not damaged.

In the mixing tip according to the present invention, the paste inlets 3*a* of the paste guiding member 3 are directly attached to the nozzles of the syringes Y and Y, as illustrated I FIG. 3. In a conventional mixing tip (disclosed in Unexamined Japanese Patent Publication No. 8-276125), since an operator must rotate a mixing tip at the time of installation, paste inlets can not be directly attached to nozzles of syringes. Therefore, in the conventional mixing tip, pastes straightly extruded from the nozzles of syringes only flow into a paste guiding member. Thus, when the inside of a mixing tip serving as a flow path is angulated, only the flow of a paste having high viscosity is stagnated. On the other hand, when the flow path is straight, only a paste having low viscosity reaches quicker to a housing. Thus, there is a problem that a kneaded material having a proper ratio cannot be obtained.

On the other hand, the mixing tip according to the present invention directly guides pastes extruded from the nozzles of syringes Y and Y to the flow paths 3*b* as illustrated in FIG. 10. Thus, the flowing directions of pastes can be easily changed just after extrusion of the pastes, and stagnation of a straightly extruded paste in an angulated flow path does not occur unlike the conventional mixing tip. Further, by adjusting the cross-sectional ratio or the volume ratio of the flow paths 3*b*, it can be prevented that only a paste having low viscosity reaches quicker to the housing 2. Thus, a kneaded material having a proper ratio can be obtained from the beginning of kneading.

Pastes used in the mixing tip according to the present invention are hardened when the pastes are kneaded. However, the pastes remained in the syringes Y and Y are not hardened because of not being mixed. Therefore, when pastes remain in the syringes Y and Y, the paste can be used later by changing the mixing tip. As for the mixing tip according to the present invention, it is also very important whether a used mixing tip can be easily changed or not.

Therefore, when the mixing tip according to the present invention has the releasing mechanism 6 in at least one pawl part 4, the locking state of the pawl part 4 with the syringe holder X can be easily released, and thus it is preferable. As for the releasing mechanism 6, for example, the pawl part 4 can be made to have a portion projected toward the outer face side of the mixing tip and a groove part around the projected portion, as illustrated in FIG. 8. When the projected portion is pushed, the pawl part 4 locked with the locking hole Xa of the syringe holder X can be moved up based on the principle of leverage. Further, as illustrated in FIG. 9, the mixing tip can be easily changed by pulling and removing the mixing tip while pushing the projected portion. Furthermore, when protrusions 7 in order to hook fingers are provided around the projected portion as illustrated in FIGS. 8 and 9, the mixing tip can be more easily pulled and removed, and thus it is preferable.

What is claimed is:

1. A mixing tip locked and fixed at two portions of a top end of a syringe holder in which two syringes are fixed in parallel, the mixing tip comprising:

a housing internally including a mixing element;

a paste guiding member including paste inlets attached to nozzles of two syringes and flow paths to introduce pastes extruded from the respective syringes into the housing through the paste inlets, the paste guiding member being fixed to an end part positioned at the opposite side to an outlet of the housing; and two locking members fixed at or integrally formed with the paste guiding member or the housing so as to be locked, in a locking state, and fixed to the syringe holder, wherein the two locking members are (1) a pawl part locked with a locking hole formed at the syringe holder and (2) a projection part, which projects further than the pawl part, inserted into a hole part provided at the syringe holder, and the pawl part includes a releasing mechanism configured to release the locking state of the pawl part with the syringe holder.

* * * * *